US011091818B2

(12) United States Patent
Kwak et al.

(10) Patent No.: US 11,091,818 B2
(45) Date of Patent: Aug. 17, 2021

(54) HIGH STRENGTH COLD-ROLLED STEEL SHEET AND HOT-DIP GALVANIZED STEEL SHEET HAVING EXCELLENT HOLE EXPANSION, DUCTILITY AND SURFACE TREATMENT PROPERTIES, AND METHOD FOR MANUFACTURING SAME

(71) Applicant: POSCO, Pohang-si (KR)

(72) Inventors: Jai-Hyun Kwak, Gwangyang-si (KR); Hang-Sik Cho, Gwangyang-si (KR); Dong-Seoug Sin, Gwangyang-si (KR)

(73) Assignee: POSCO, Pohang-si (KR)

( * ) Notice: Subject to any disclaimer, the term of this patent is extended or adjusted under 35 U.S.C. 154(b) by 333 days.

(21) Appl. No.: 15/781,619

(22) PCT Filed: Dec. 20, 2016

(86) PCT No.: PCT/KR2016/014934
§ 371 (c)(1),
(2) Date: Jun. 5, 2018

(87) PCT Pub. No.: WO2017/111428
PCT Pub. Date: Jun. 29, 2017

(65) Prior Publication Data

US 2018/0371569 A1 Dec. 27, 2018

(30) Foreign Application Priority Data

Dec. 23, 2015 (KR) ..... 10-2015-0185458
Dec. 23, 2015 (KR) ..... 10-2015-0185462

(51) Int. Cl.
*C21D 8/02* (2006.01)
*C22C 38/02* (2006.01)
(Continued)

(52) U.S. Cl.
CPC ..... *C21D 8/0273* (2013.01); *C21D 8/0226* (2013.01); *C21D 8/0236* (2013.01);
(Continued)

(58) Field of Classification Search
None
See application file for complete search history.

(56) References Cited

U.S. PATENT DOCUMENTS 6,030,714 A 2/2000 Fujibayashi et al.
2009/0308498 A1 12/2009 Matsumura et al.
(Continued)

FOREIGN PATENT DOCUMENTS

CN 1103437 6/1995
CN 1275173 11/2000
(Continued)

OTHER PUBLICATIONS

Unknown, "An Introduction to the Metallurgy of Steel", The Ferrous Metals Data Book, retrieved from http://www.oocities.org/ferritec_eng/toc.htm (Year: 2009).*
(Continued)

*Primary Examiner* — Coris Fung
*Assistant Examiner* — Christopher D. Moody
(74) *Attorney, Agent, or Firm* — Cantor Colburn LLP

(57) ABSTRACT

Provided are a high-strength cold-rolled steel sheet and a hot-dip galvanized steel sheet comprising in % by weight: 0.05 to 0.3% of carbon (C); 0.6 to 2.5% of silicon (Si); 0.01 to 0.5% of aluminum (Al); 1.5 to 3.0% of manganese (Mn); and the remainder being Fe and unavoidable impurities, the steel sheet has a microstructure comprised of, in an area fraction, ferrite in an amount of 60% or less, lath-type bainite of 25% or more, martensite of 5% or more, and lath-type retained austenite in an amount of 5%, wherein the ferrite has an average grain diameter of 2 μm or less and the
(Continued)

ferrite satisfies Fn2, defined by relational expression 1, is 89% or more and Fa5, defined by relational expression 2, is 70% or less.

7 Claims, 7 Drawing Sheets

(51) Int. Cl.

| | |
|---|---|
| ***C22C 38/04*** | (2006.01) |
| ***C22C 38/06*** | (2006.01) |
| ***C22C 38/44*** | (2006.01) |
| ***C22C 38/50*** | (2006.01) |
| ***C22C 38/54*** | (2006.01) |
| ***C22C 38/58*** | (2006.01) |
| ***C23C 2/06*** | (2006.01) |
| ***C23C 2/40*** | (2006.01) |
| ***C23C 2/26*** | (2006.01) |
| ***C23C 2/28*** | (2006.01) |

(52) U.S. Cl.

CPC ..... *C22C 38/02* (2013.01); *C22C 38/04* (2013.01); *C22C 38/06* (2013.01); *C22C 38/44* (2013.01); *C22C 38/50* (2013.01); *C22C 38/54* (2013.01); *C22C 38/58* (2013.01); *C23C 2/06* (2013.01); *C23C 2/26* (2013.01); *C23C 2/28* (2013.01); *C23C 2/40* (2013.01); *C21D 2211/001* (2013.01); *C21D 2211/002* (2013.01); *C21D 2211/005* (2013.01); *C21D 2211/008* (2013.01)

(56) References Cited

U.S. PATENT DOCUMENTS

| | | | |
|---|---|---|---|
| 2012/0118438 | A1 | 5/2012 | Nakagaito et al. |
| 2013/0133792 | A1 | 5/2013 | Nakagaito et al. |
| 2014/0363697 | A1 | 12/2014 | Kim et al. |
| 2016/0177414 | A1 | 6/2016 | Takashima et al. |
| 2017/0051378 | A1 | 2/2017 | Lee et al. |

FOREIGN PATENT DOCUMENTS

| | | |
|---|---|---|
| CN | 1692166 | 11/2005 |
| CN | 102803540 | 11/2012 |
| CN | 104024452 | 9/2014 |
| CN | 104726770 | 6/2015 |
| EP | 1486574 | 12/2004 |
| JP | 2002047535 | 2/2002 |
| JP | 2006299290 | 11/2006 |
| JP | 2007138216 | 6/2007 |
| JP | 2008190030 | 8/2008 |
| JP | 2010275627 | 12/2010 |
| JP | 2013216946 | 10/2013 |
| JP | 2014019905 | 2/2014 |
| JP | 2015034327 | 2/2015 |
| JP | 2015504976 | 2/2015 |
| JP | 2015071824 | 4/2015 |
| JP | 2017519900 | 7/2017 |
| KR | 19980702926 | 9/1998 |
| KR | 100608555 | 8/2006 |
| KR | 20130027794 | 3/2013 |
| KR | 20150130612 | 11/2015 |
| WO | 2015015239 | 2/2015 |
| WO | 2015019558 | 2/2015 |
| WO | 2015174605 | 11/2015 |

OTHER PUBLICATIONS

Espacenet machine translation of JP 2002-047535 (Year: 2020).*

Chinese Office Action—Chinese Application No. 201680075989.X dated Aug. 26, 2019, citing CN1692166, JP2002047535, CN102803540, CN1103437, CN1275173, CN104024452 and CN104726770.

Japanese Office Action—Japanese Application No. 2018-532467 dated Jul. 16, 2019, citing JP 2017-519900, JP 2015-034327, JP 2008-190030, JP 2015-504976, JP 2015-071824 and US 2013/0133792.

International Search Report—PCT/KR2016/014934 dated Mar. 27, 2017.

European Search Report—European Application No. 16879295.0, dated Aug. 17, 2018, citing EP 1 486 574, JP 2002 047535, WO 2015/174605 and WO 2015/019558.

* cited by examiner (a)

(b)

HIGH STRENGTH COLD-ROLLED STEEL SHEET AND HOT-DIP GALVANIZED STEEL SHEET HAVING EXCELLENT HOLE EXPANSION, DUCTILITY AND SURFACE TREATMENT PROPERTIES, AND METHOD FOR MANUFACTURING SAME

TECHNICAL FIELD

The present disclosure relates to a high strength steel sheet used in a structural member of automobiles and, more particularly, to a high strength cold-rolled steel sheet and hot-dip galvanized steel sheet having excellent hole expansion, elongation, press formability, phosphatability and spot weldability, and a method for manufacturing the same.

BACKGROUND ART

In order to reduce the weight of automobiles, attempts have been made to increase strength, and reduce a thickness, of a steel sheet applied as a structural member. However, an increase in the strength of a steel sheet may relatively lower press formability. In order to improve press formability, a high hole expansion ratio, in addition to the elongation of steel, is required, and thus, a transformed structure steel utilizing a retained austenite phase, together with martensite and bainite, low temperature structures, has been developed and applied. However, since a large amount of alloying elements may be added, and, in particular, a large amount of silicon (Si) or aluminum (Al), relative to general steel, is added to secure retained austenite, Si concentrated products or oxides may be formed on the surface. As a result, the cold-rolled steel sheet may have poor phosphatability and the hot-dip galvanized steel sheet may have a problem of deterioration of plating quality and cracks in a spot-welded portion.

In order to solve such problems, a method of securing a structure excellent in terms of workability by lowering a composition of an alloy and by annealing two times, adhering Ni or the like, to a surface of a steel sheet after annealing with an adhesion amount of 5 to 70 mg/m$^2$ (JP2002-47535A) has been proposed. However, since a plate shape may be relatively poor due to the cooling rate of 30° C./sec. or more during primary annealing, there may be a problem of partial plating failure due to irregular plating during plating of a metal such as Ni after the primary annealing, and due to the surface oxidation defects resulted from the remaining moisture after rinsing and drying in the annealing.

On the contrary, there has been proposed a method of securing quality in hot-dip galvanizing by reducing the amount of Si and Mn concentrated on the surface by causing internal oxidation during annealing (KR1998-7002926A). This method, however, has a limitation in securing excellent elongation and hole expansion ratio and a problem of an increasing amount of alloy to secure retained austenite.

Further, since the surface oxides of Si and Mn formed during the annealing inhibit a phosphate treatment of the cold-rolled steel sheet, adhesion of an electrocoating layer is lowered to cause corrosion of an electrodeposited coating-removed layer due to chipping, or the like, to result in a degradation of durability of a vehicle component.

DISCLOSURE

Technical Problem

An aspect of the present disclosure may provide a cold-rolled steel sheet, a hot-dip galvanized steel sheet, and alloyed hot-dip galvanized steel sheet, which form a unique structure by utilizing an inverse-transformation phenomenon to have excellent ductility and an excellent hole expansion ratio, relative to the conventional method, in spite of using a general alloy component and, which have corrosion resistance and good surface quality in assembled parts, as well as press formability, significantly improved by enhancing phosphatability, plating layer adhesion, and plating quality.

An aspect of the present disclosure may also provide a method of manufacturing the steel sheet.

Technical subjects obtainable from the present invention are not limited by the above-mentioned technical task. Moreover, other unmentioned technical tasks will be clearly understood from the following description by those having ordinary skill in the technical field to which the present invention pertains.

Technical Solution

According to an aspect of the present disclosure, a high-strength cold-rolled steel sheet having excellent ductility, hole expandability and surface treatment properties, includes: in % by weight, 0.05 to 0.3% of carbon (C), 0.6 to 2.5% of silicon (Si), 0.01 to 0.5% of aluminum (Al), 1.5 to 3.0% of manganese (Mn), a remainder of Fe, and unavoidable impurities, the steel sheet has a microstructure comprised of, in an area fraction, ferrite in an amount of 60% or less, lath-type bainite of 25% or more, martensite of 5% or more, and lath-type retained austenite in an amount of 5% or more, the ferrite has an average grain diameter of 2 μm or less and the ferrite satisfies Fn2 defined by relational expression 1 being 89% or more and Fa5, defined by relational expression 2, being 70% or less.

$$Fn2=[\text{Number of ferrite grains of 2 μm or less/number of total ferrite grains}]\times 100 \quad \text{[Relational expression 1]}$$

$$Fa5=[\text{area of ferrite grains of 5 μm or greater/area of total ferrite grains}]\times 100 \quad \text{[Relational expression 2]}$$

The sum of one or two or more of Cr, Ni, and Mo, which is 2% or less (excluding 0%), may be additionally included.

0.05% or less of Ti (excluding 0%) and 0.003% or less of B (excluding 0%) may be additionally included.

A Ni or Fe plating layer may be formed at a coating weight of 5 to 40 mg/m$^2$ on the surface.

In a hot-dip galvanized steel sheet formed by forming a hot-dip galvanized plating layer on a surface of the cold-rolled steel sheet, a Ni or Fe plating layer may be formed at a coating weight of 100 mg/m$^2$ or greater between the cold-rolled steel sheet and the hot-dip galvanized plating layer.

According to another aspect of the present disclosure, an alloying hot-dip galvanized steel sheet obtained by performing an alloying heat treatment on the hot-dip galvanized steel sheet may be provided.

According to another aspect of the present disclosure, a method for manufacturing high-strength cold-rolled steel sheet having excellent ductility, hole expandability and surface treatment properties, includes: preparing a steel slab including: in % by weight, 0.05 to 0.3% of carbon (C), 0.6 to 2.5% of silicon (Si), 0.01 to 0.5% of aluminum (Al), 1.5 to 3.0% of manganese (Mn), a remainder of Fe, and unavoidable impurities, and reheating the steel slab; rolling the re-heated steel slab under general hot-rolling conditions and subsequently coiling in a temperature range of 750° C. to 550° C.; cold-rolling the coiled hot-rolled steel sheet to manufacture a cold-rolled steel sheet; performing primary annealing to heat the cold-rolled steel sheet to a temperature equal to or higher than an Ac3 point and subsequently cool the cold-rolled steel sheet to a temperature equal to or lower than 350° C. at a cooling rate of less than 20° C./s; and performing secondary annealing to heat the cold-rolled steel sheet to a temperature ranging from Ac1 to Ac3, after the primary annealing, and maintain the cold-rolled steel sheet, cool the cold-rolled steel sheet to a temperature ranging from Ms to Bs at a cooling rate of less than 20° C./s, maintain the cold-rolled steel sheet for 30 seconds or longer, and finally cool the cold-rolled steel sheet.

The cold-rolled steel sheet may have a microstructure before the secondary annealing, including ferrite in an amount of 20% or less by an area fraction and a remaining low-temperature transformed microstructure.

The method may further include: forming a Ni or Fe plating layer on a surface of the secondarily annealed steel plate at a coating weight of 5 to 40 mg/m$^2$.

A Ni or Fe plating layer may be formed at a coating weight of 5 to 40 mg/m$^2$ on a surface of the steel sheet, before the secondary annealing, after the primary annealing.

The present disclosure may provide a hot-dip galvanized steel sheet formed by performing Ni or Fe plating at a coating weight of 100 mg/m$^2$ or greater on a surface of the steel plate after the primary annealing and subsequently performing hot-dip galvanizing, and an alloying hot-dip galvanized steel sheet formed by performing an alloying heat treatment on the hot-dip galvanized steel sheet.

Advantageous Effects

According to an exemplary embodiment in the present disclosure, there are provided a high strength cold-rolled steel sheet, a hot-dip galvanized steel sheet, and an alloyed hot-dip galvanized steel sheet, having excellent ductility and hole expansion, as well as excellent press formability of tensile strength of 980 MPa or more, as compared with high ductility transformation textured steel such as existing DP steel or TRIP steel and quenching & partitioning (Q&P) steel having been subjected to a Q&P heat treatment.

In addition, as Ni and Fe are plated after primary and secondary annealing processes, a cold-rolled steel sheet may have excellent phosphate treatment properties and may thus have excellent adhesion in an electrodeposition coating layer. As Ni, Fe and the like are plated before secondary annealing, a hot-dip galvanized steel sheet may have excellent plating adhesion, and no defects such as non-plating, and thus, may have excellent moldability and corrosion resistance to be excellent in spot weldability. Thus, there may be an advantage, in that the safety and life of automobile components may be prolonged.

In addition, the cold-rolled steel sheet according to an exemplary embodiment may have an advantage of being highly available in industrial fields such as building members, automotive steel sheets, and the like.

DESCRIPTION OF DRAWINGS

The patent or application file contains at least one drawing executed in color. Copies of this patent or patent application publication with color drawings will be provided by the Office upon request and payment of the necessary fee.

BEST MODE FOR INVENTION

Figure 1:
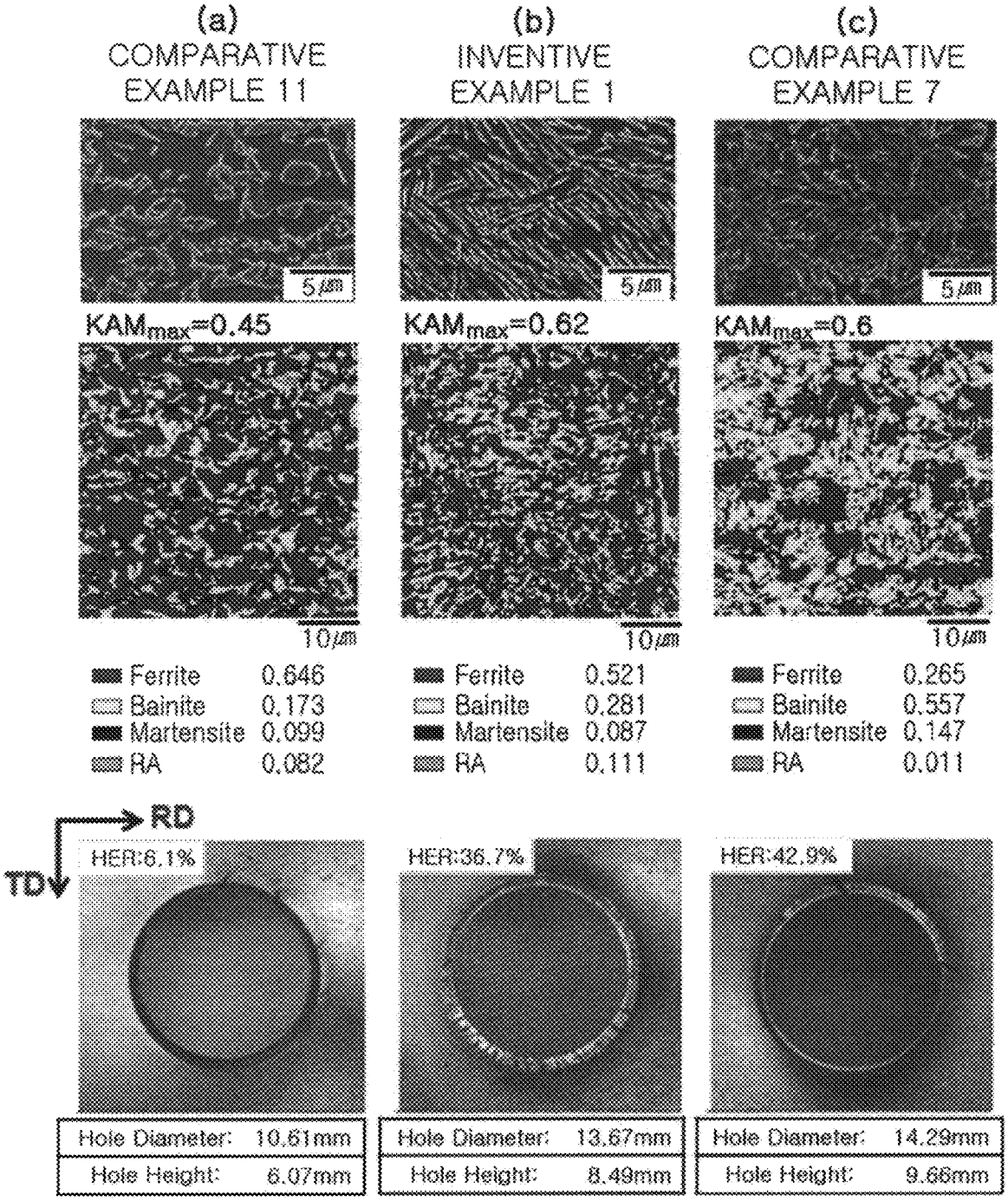
FIG. 1 is photographs of a composition of steel microstructures affecting hole expansion ratio and elongation and effects of geometrical structure according to an inventive example of the present embodiment and comparative examples.

Exemplary embodiments of the present disclosure will now be described in detail with reference to the accompanying drawings.

Hereinafter, the present disclosure will be described.

In the related art, steel utilizing retained austenite to improve elongation is not favorable for hole expansion ratios. Also, in a microstructure refining method utilizing inverse-transformation to improve hole expansion ratio and elongation, a cooling rate is 20° C./s or higher to obtain a martensite structure in a primary heat treatment process. In this case, however, as the cooling rate increases, cooling is locally uneven to cause a plate to be distorted to have a poor shape, resulting in a problem in press forming.

The inventors of the present application confirmed through research and experimentation that fine lath-type ferrite, bainite and retained austenite microstructures obtained by inverse transformation heat treatment are important means for ensuring hole expansion ratios and elongation at the same time. It was also confirmed that a particle size distribution of ferrite plays an important role.

Also, the inventors of the present application discovered a steel composition range for obtaining the aforementioned microstructure even under conditions in which a cooling rate is significantly lower than that of the related art to obtain an excellent plate shape and discovered a means for solving the problems of a phosphate coating formation defect, partial unplating, and welding portion cracks which most frequently appear in the conventional Si-added high alloy steel, thereby completing the present disclosure.

The high-strength cold-rolled steel sheet, excellent in terms of ductility, hole formability and surface treatment characteristics of the present disclosure includes 0.05 wt % to 0.3 wt % of carbon (C), 0.6 wt % to 2.5 wt % of silicon (Si), 0.01 wt % to 0.5 wt % of aluminum (Al), 1.5 wt % to 3.0 wt % of manganese (Mn), the remainder comprising iron (Fe), and unavoidable impurities.

Hereinafter, the alloy composition of the cold-rolled steel sheet of the present disclosure and the reasons for restricting the alloy composition will be described in detail. Here, the content of each component means wt % unless otherwise specified.

C: 0.05% to 0.3%

Carbon (C) is an element effective in strengthening steel. In the present disclosure, carbon (C) is an important element added for stabilizing the retained austenite and securing strength. In order to obtain the above-mentioned effect, preferably, the content of C is 0.05% or greater. However, if the content exceeds 0.3%, the risk of strip defects increases. In addition, weldability may be significantly lowered, and further, such a content of C may be problematic because the steel is required to be cooled to a lower temperature to obtain a martensite structure during primary annealing. Therefore, the content of C in the present disclosure is preferably limited to 0.05% to 0.3%.

Si: 0.6% to 2.5%

Silicon (Si) is an element that suppresses the precipitation of carbides in ferrite and promotes diffusion of carbon in ferrite to austenite, resultantly contributing to the stabilization of retained austenite. In order to obtain the above-mentioned effect, preferably, Si is added in an amount of at least 0.6%. If the content exceeds 2.5%, the hot and cold rolling properties may be extremely poor and oxides may be formed on the surface of the steel to degrade plating properties (or galvanizability). Therefore, the content of Si in the present disclosure is preferably limited to 0.6% to 2.5%.

Al: 0.01% to 0.5%

Aluminum (Al) is an element which bonds with oxygen in the steel to deoxidize it. To this end, preferably, the content of Al is maintained at 0.01% or more. Al also contributes to stabilization of the retained austenite by suppressing formation of a carbide in the ferrite like Si. If the content of Al exceeds 0.5%, it is difficult to produce a sound slab due to a reaction with the mold flux during casting and a surface oxide is formed to deteriorate plating properties. Therefore, the content of Al in the present disclosure is preferably limited to 0.01% to 0.5%.

Mn: 1.5% to 3.0%

Manganese (Mn) is an element effective for forming and stabilizing retained austenite, while controlling the transformation of ferrite. If the content of Mn is less than 1.5%, a large amount of ferrite transformation occurs, making it difficult to obtain desired strength. If, however, the content of Mn exceeds 3.0%, phase transformation in secondary annealing of the present disclosure may be delayed so much as to form a large amount of martensite structure, causing a problem that it is difficult to secure intended ductility. Therefore, the content of Mn in the present disclosure is preferably limited to 1.5% to 3.0%.

As an impurity element of the steel of the present disclosure, P is preferably 0.03% or less, and if the content of P exceeds 0.03%, weldability may be lowered and the risk of brittleness of the steel may be increased.

S is preferably 0.015% or less. Sulfur (S) is an impurity element inevitably contained in the steel, and the content of S is preferably maximally suppressed. In theory, it is advantageous to limit the content of S to 0%, but since S is inevitably contained due to a manufacturing process, it is important to manage an upper limit. If the content of S exceeds 0.015%, the possibility of inhibiting ductility and weldability of the steel sheet is high.

N is preferably 0.02% or less. Nitrogen (N) is an element effective in stabilizing austenite. However, if the content of N exceeds 0.02%, the risk of brittleness of steel may be increased and N may react with Al to result in excessive precipitation of AlN and deterioration in continuous casting quality.

The cold-rolled steel sheet of the present disclosure may further include at least one of Cr, Ni, Mo, Ti, and B in addition to the above-described components for the purpose of strength improvement, and the like.

That is, in the present disclosure, the total content of one or more of Cr, Ni and Mo: 2% or less (here, 0% is not included) may be further included. Molybdenum (Mo), nickel (Ni) and chromium (Cr) are elements contributing to stabilization of retained austenite. These elements complexly act together with C, Si, Mn, Al, and the like, to contribute to stabilization of austenite. If the content of these elements, specifically, Mo, Ni, and Cr, exceeds 2.0%, manufacturing cost may be excessively increased. Therefore, it is preferable to control the content not to exceed the above content.

In the present disclosure, Ti in an amount of 0.05% or less (excluding 0%) and B in an amount of not more than 0.003% (excluding 0%) may be additionally included.

In the present disclosure, preferably, Ti in an amount of 0.05% or less may be added in a case in which Al exceeds 0.05% or B is added. Ti is an element that forms TiN, and the addition of a larger amount of Ti may be effective because it is deposited at a temperature higher than B or Al, which, however, involves a problem of nozzle clogging during continuous casting and an increase in costs. When Ti is added in the amount of 0.05%, even at an upper limit of addition of Al and B, Ti may act as a solid-solution element without forming AlN or BN, so the upper limit is set as 0.05%.

B (boron) has an effect of suppressing soft ferrite transformation at a high temperature by improving hardenability by complex effects with Mn, Cr, and the like. However, if the content exceeds 0.003%, excessive B may be concentrated on the surface of the steel during plating to degrade plating adhesion, as well as suppressing bainite transformation to decrease hole expansion ratio and elongation, and thus, the content of B may be 0.003% or less.

The remainder of the present disclosure is iron (Fe). However, in the general steel manufacturing process, impurities which are not intended may be inevitably mixed from a raw material or a surrounding environment, which may not be excluded. These impurities are known to anyone skilled in the art of general steel manufacturing processes and are thus not specifically mentioned in this disclosure.

In the high-strength cold-rolled steel sheet excellent in ductility, hole-formability and surface treatment characteristics of the present disclosure, a steel microstructure includes, by an area ratio, 60% or less of ferrite, 25% or more of lath-type bainite, 5% or more of martensite, and 5% or more of lath-type austenite. That is, the steel microstructure of the cold-rolled steel sheet of the present disclosure includes ferrite, and lath-type bainite, martensite, and lath-type retained austenite. These structures are main structures of the steel sheet of the present disclosure which are advantageous for ensuring hole expandability, ductility, and strength, and thereamong, the martensite structure is partly included in the steel structure due to heat treatment in a manufacturing process described hereinafter.

In the microstructure, the ferrite includes coarse polygonal ferrite and lath-type ferrite and is included in an amount of 60% as an area percentage with respect to the overall structure. If the ferrite structure exceeds 60%, strength is lowered and the fraction of coarse polygonal ferrite is increased. In addition, a difference in the content of the elements of partitioning such as carbon, manganese, and the like, with the remaining transformed structure is increased to cause cracking to easily occur during hole expansion, degrading hole expansion ratio.

The bainite structure is mostly present as a lath type and forms a boundary with surrounding ferrite, martensite, and retained austenite. Since bainite has intermediate strength between ferrite and the two-phase structure (martensite and retained austenite), bainite alleviates interphase interfacial separation during hole expansion to enhance hole expansion ratio, and thus, at least 25% of bainite is required, and in the present invention, 25% is a lower limit.

The martensite structure is formed when the chemically unstable austenite is cooled to room temperature during final cooling, lowering elongation of the steel. However, in the present disclosure, the martensite structure is used as a means for enhancing strength in spite of lowering the alloy element. If the martensite structure is smaller, more alloying elements must be added. Thus, the lower limit of the martensite by area ratio was set to 5%.

In the present disclosure, the retained austenite is a very important structure for ensuring ductility and hole expansion ratio. Therefore, the more the better, but there may be a problem in that a large amount of austenite stabilizing alloy element such as carbon may need to be added, increasing costs and lowering weldability. In particular, when the lath-type retained austenite is formed, as in the present disclosure, the stability of austenite is significantly increased even in the same chemical component, so it is not necessary to include a large amount as in the conventional method. However, in order to obtain both ductility and hole expansion ratio which are 20% or more, a minimum of 5% of the retained austenite is required and the lower limit is set to be 5%.

Figure 2:
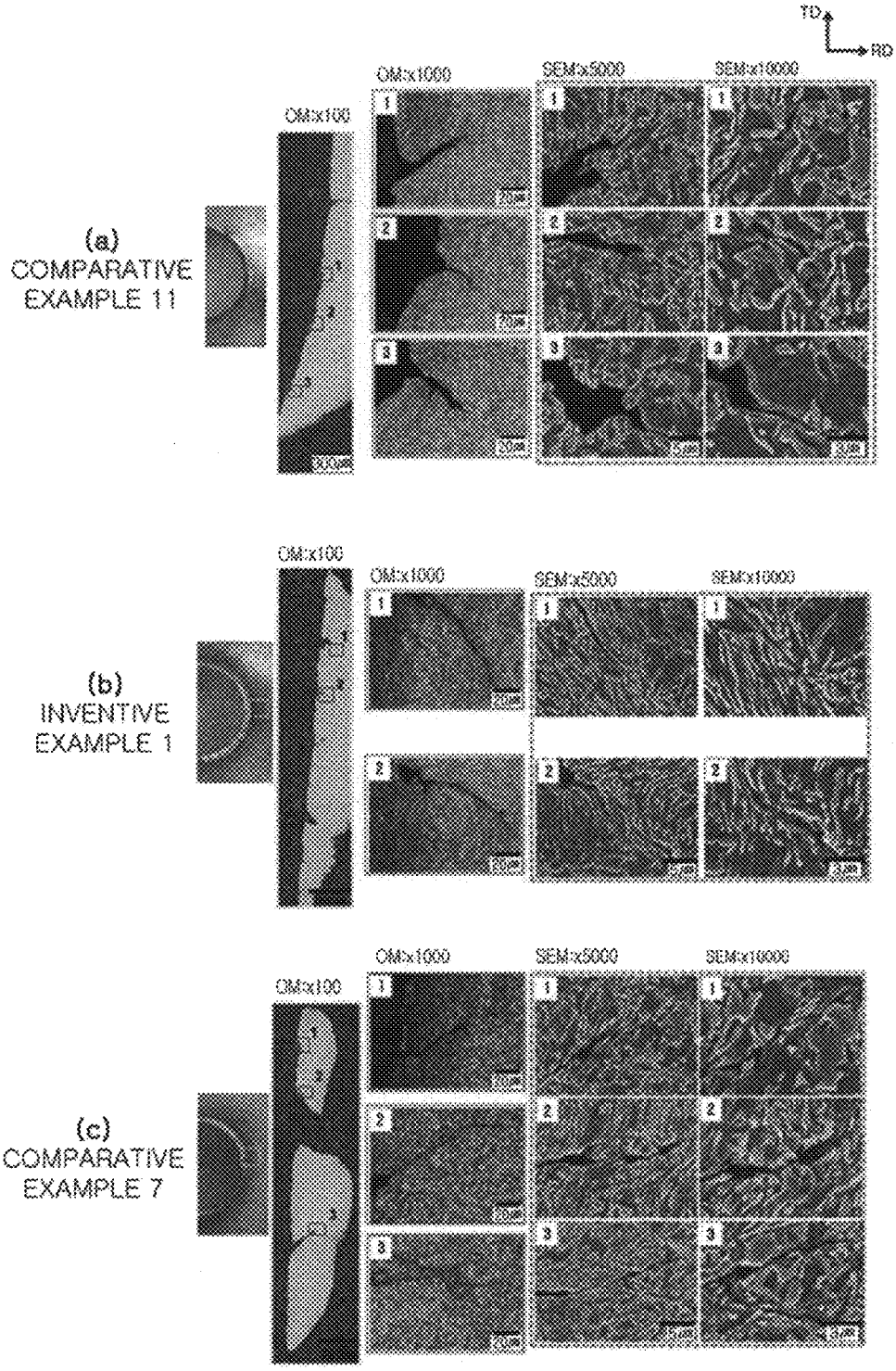
FIG. 2 is photographs of structures in which cracking occurs in hole expansion in the structure photograph of FIG. 1.

In the present disclosure, it is important to control the fraction and the size of the structure of the ferrite. This may be understood by the fact that, as shown in FIGS. 1 and 2, in the coarse polygonal ferrite, cracks easily propagate along the boundary of a neighboring second phase when the hole is expanded, but when the lath-type ferrite is dispersed, crack propagation is suppressed and the hole expandability is improved. Therefore, the present disclosure is characterized in that the fraction and size of ferrite are controlled using a heat treatment method as described hereinafter.

Specifically, the ferrite has an average grain diameter of 2 μm or less and satisfies a distribution of Fn2 defined by the following [Relational expression 1] to be 89% or more and Fa5 defined by the following [Relational expression 2] to be 70% or less.

$$Fn2=[\text{number of ferrite grains of 2 μm or less/number of total ferrite grains}]\times 100 \quad \text{[Relational Expression 1]}$$

$$Fa5=[\text{area of ferrite grains of 5 μm or greater/area of total ferrite grains}]\times 100 \quad \text{[Relational Expression 2]}$$

Figure 5:
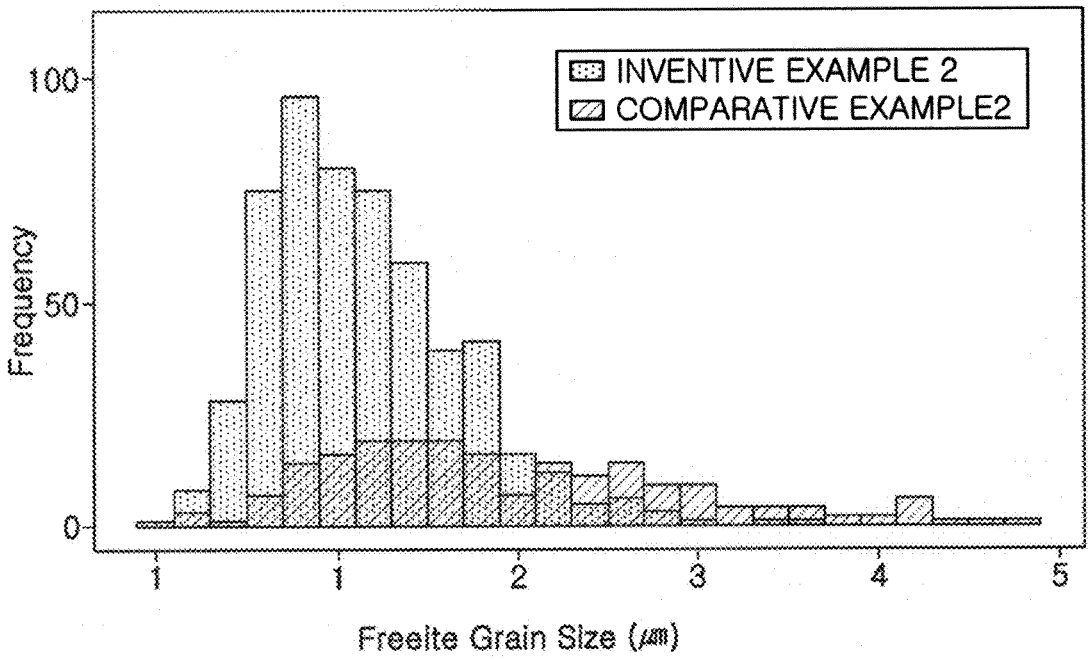
FIG. 5 is a graph showing a difference in observation frequency of ferrite grain sizes according to an inventive example and a comparative example.

In the present disclosure, the term "lath-type ferrite" refers to ferrite in which a length ratio of a longer side to a shorter side of the ferrite is 4 or greater, and the size was evaluated by an image analyzer including an analysis program in which several polygons are taken as being connected (crystal grain measurement method of ASTM E112). As a result, the grain size and the number of grains as shown in FIG. 5 were measured, based on which the size and distribution of ferrite grains of steel having excellent elongation and hole expansion ratio were determined.

Specifically, the present technical composition is proposed by confirming that when the ferrite has an lath-type ferrite structure having an average size of 2 μm or less and a distribution satisfying the relational expressions 1 and 2, hole expansion ratio was excellent as 28% or more and elongation was excellent as 20% or more.

The cold-rolled steel sheet of the present disclosure satisfying the microstructure and the size and distribution of ferrite has tensile strength of 980 MPa or greater and ensures excellent hole expansion ratio and ductility, relative to the conventional TRIP steel manufacturing method, Q&P heat treatment method, and re-heat treatment method for inverse transformation.

The cold-rolled steel sheet of the present disclosure having excellent ductility, hole-formability, and surface treatment characteristics includes a Ni or Fe plating layer formed on a surface thereof, and here, a coating weight is preferably 5 to 40 mg/m$^2$. If the coating weight is less than 5 mg/m$^2$, Mn or Si oxide may be easily formed on the surface due to the fine oxidation during or after annealing, and as a result, a phosphate coating is not formed to degrade adhesion between the electrodeposition coating layer and the base steel sheet. On the other hand, if the coating weight of Ni or Fe is more than 40 mg/m$^2$, the phosphate crystal is coarsened to decrease fine phosphate unevenness, lowering adhesion.

Further, the present disclosure is not limited to the cold-rolled steel sheet having the above-described composition, structure, and the like, and may provide a hot-dip galvanized steel sheet having a hot-dip galvanized layer formed on the surface of the cold-rolled steel sheet. Here, preferably, a Ni or Fe plating layer is formed between the cold-rolled steel sheet and the hot-dip galvanized layer at a coating weight of 100 mg/m$^2$ or more.

Further, an alloyed hot-dip galvanized steel sheet including an alloyed hot-dip plating layer as a layer obtained by performing an alloying heat treatment on the hot-dip galvanized steel sheet may also be provided.

Next, a method of manufacturing a cold-rolled steel sheet of the present disclosure will be described in detail.

The cold-rolled steel sheet according to the present disclosure may be manufactured by performing reheating, hot-rolling, coiling, cold-rolling, and annealing on a steel slab satisfying the composition proposed in the present disclosure. Hereinafter, conditions of each process will be described in detail.

[Steel Slab Reheating]

In the present disclosure, it is preferable to perform an operation of reheating and homogenizing on a steel slab having the above-mentioned composition prior to hot rolling, and here, the operation is preferably performed in a general temperature range of 1000 to 1300° C.

If the temperature during reheating is lower than 1000° C., a rolling load may increase rapidly, and if the temperature exceeds 1300° C., energy costs may increase and the amount of surface scale may be excessive. Therefore, in the present disclosure, the reheating is preferably performed at 1000 to 1300° C.

[Hot Rolling]

In the present disclosure, the reheated steel slab is hot-rolled to produce a hot-rolled steel sheet. In this case, hot strip finishing is preferably performed at a temperature of 800 to 1000° C., under general conditions.

If the rolling temperature is lower than 800° C., the rolling load is increased significantly to cause difficulty in rolling. On the other hand, if the hot rolling temperature exceeds 1000° C., thermal fatigue of the rolling roll is significantly increased to shorten service life. Therefore, in the present disclosure, the hot rolling temperature during hot rolling is preferably limited to 800 to 1000° C.

[Coiling]

Next, in the present disclosure, the hot-rolled steel sheet produced as described above is coiled, and here, a coiling temperature is preferably in the range of 750° C. to 550° C.

If the coiling temperature at the time of coiling is too high, excessive scale is generated on the surface of the hot-rolled steel sheet, causing surface defects and deteriorating plating properties. Thus, the coiling process is preferably performed at 750° C. or lower. Here, a lower limit of the coiling temperature is not limited but is set to 550° C. in consideration of the difficulty of subsequent cold rolling as strength of the hot-rolled sheet is excessively increased due to formation of martensite.

[Cold Rolling]

Pickling is performed on the coiled hot-rolled steel sheet through a general method to remove the oxide layer and cold rolling is subsequently performed thereon to adjust a shape and a thickness of the steel sheet, thus manufacturing a cold-rolled steel sheet.

Generally, cold rolling is performed in order to secure a thickness required by a customer, and here, there is no limitation at a reduction rate, but in order to suppress generation of coarse ferrite grains during recrystallization in subsequent annealing, cold rolling may be performed at a cold reduction rate of 30% or greater.

[Annealing]

The present disclosure is to manufacture a cold-rolled steel sheet including lath-type ferrite in which a ratio of a longer axis and a shorter axis is 4 or greater and lath-type retained austenite phase as a main phase, as a final microstructure, and in order to obtain such a cold-rolled steel sheet, it is important to control the follow-up annealing. Particularly, in the present disclosure, in order to secure a desired microstructure from the partitioning of elements such as carbon, manganese, and the like, during annealing, a partitioning heat treatment is performed to secure a low temperature structure through primary annealing and secure the lath-type ferrite and the retained austenite during secondary annealing as described hereinafter, instead of continuous annealing after general cold rolling.

Primary Annealing

First, primary annealing is performed to anneal the manufactured cold-rolled steel sheet at a temperature equal to or higher than an Ac3 point and subsequently cool the annealed cold-rolled steel sheet to a temperature equal to or lower than 350° C. at a cooling rate of less than 20° C./s (See (a) of FIG. 3)).

This is to obtain ferrite having an area fraction of 20% or less and the remaining low-temperature transformed structure (bainite and martensite) as a main phase of the microstructure of the primarily annealed cold-rolled steel sheet. This is to ensure excellent strength and ductility of the cold-rolled steel sheet manufactured through final secondary annealing. If the ferrite fraction exceeds 20% due to slow cooling after the primary annealing, the cold-rolled steel sheet of the present disclosure including ferrite, retained austenite, and low-temperature structure phase as described above may not be obtained.

That is, if the annealing temperature is lower than an Ac3 point or if the cooling rate is too slow, a large amount of soft polygonal ferrite is formed so that when the ferrite/austenite coexisting region is annealed during the subsequent secondary annealing, the area ratio of ferrite of 5 μm or greater increases due to the previously formed polygonal coarse ferrite.

Further, in order to obtain the structure through the primary annealing, a cooling rate, as well as the annealing temperature, is important. If the cooling rate is 20° C./s or higher, the steel is inflated by the low-temperature transformed structure formed unevenly to distort the sheet and make the sheet wavy to result in a bad sheet shape, and sheet steering may cause strip breakage. In order to suppress this, the cooling rate is preferably lower than 20° C./s and the lower limit is only required to obtain the ferrite having the above-mentioned area fraction of 20% or less and the remaining low-temperature transformed structure. Preferably, a cooling end temperature or an isothermal maintaining start temperature after cooling may be 350° C. or lower. This is because, if the cooling end temperature or the isothermal maintaining start temperature after cooling is higher than 350° C., carbide precipitation increases in the bainite so that a lath-type microstructure based on inverse transformation may not be obtained.

In the present disclosure, after the primary annealing, Ni or Fe plating may be performed on the surface of the steel sheet before the subsequent secondary annealing, and the coating weight may be in the range of 5 to 40 mg/m$^2$. Ni or Fe plated on the surface of the steel sheet may be diffused to the base steel sheet during the subsequent secondary annealing so as to become extinct, but Ni, or the like, diffused on the surface acts to suppress oxidation of the steel sheet and as such Ni, or the like, is desirable.

Secondary Annealing

Figure 3:
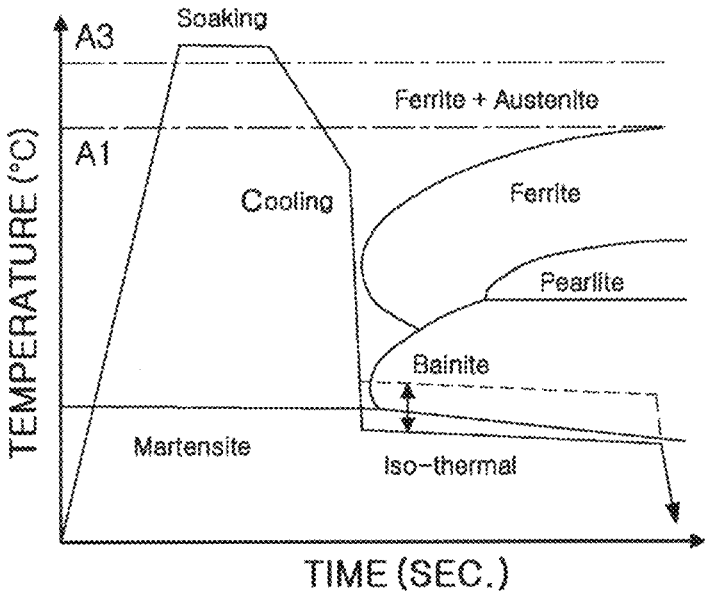
FIG. 3 shows an example of annealing according to the present disclosure (the dotted line in (b) of FIG. 1) indicates thermal history at the time of the hot alloying galvanizing).
Figure 3:
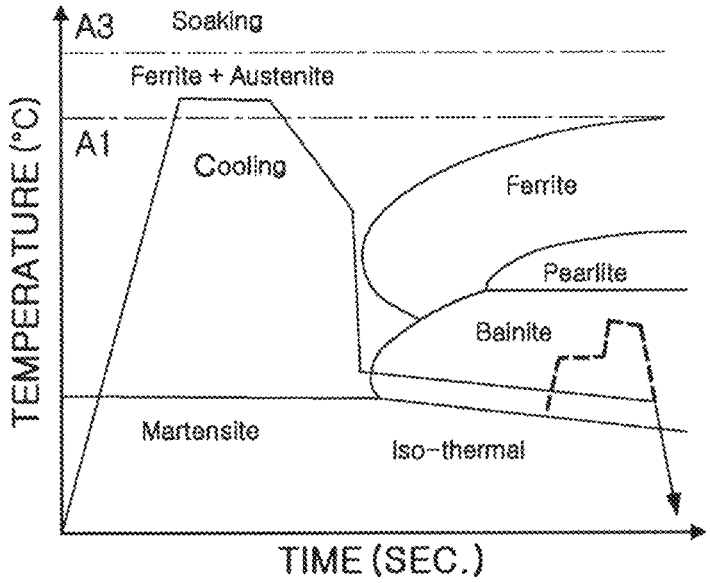

In the present disclosure, after the primary annealing is completed, secondary annealing is performed to heat and maintain the steel sheet in the range of Ac1 to Ac3, cool the steel sheet to a temperature range of Ms to Bs at a cooling rate of less than 20° C./s, and then maintain and cool the steel sheet for 30 seconds or longer (See (b) of FIG. 3).

In the present disclosure, heating the steel sheet in the range of Ac1 to Ac3 is intended to forma fine ferrite and austenite which are maintained in a lath-type structure by the inverse transformation phenomenon as the low temperature transformed structure obtained in the primary annealing is heated in two phases. Also, it is to ensure stability of austenite through alloying element distribution to austenite during annealing to secure retained austenite in a final structure at room temperature.

Also, maintaining the corresponding temperature after the heating is intended to induce partitioning of the alloying elements such as carbon manganese, and the like, together with inverse transformation of the formed low-temperature structure (bainite and martensite) after the primary annealing. This partitioning here will be referred to as primary partitioning.

Meanwhile, maintaining of the alloying elements for the primary partitioning is not limited in time because it may be performed such that the alloying elements are sufficiently diffused to the austenite side. However, if the maintaining time is excessive, productivity may be deteriorated and the partitioning effect may also be saturated. Therefore, it is preferable to carry out the maintaining time for a period of time within 2 minutes.

After completion of the primary partitioning of the alloying elements as described above, the steel sheet may be cooled to a temperature range of Ms (martensitic transformation starting temperature) to Bs (bainite transformation starting temperature) at a cooling rate of less than 20° C./s, isothermal temperature may be maintained for 30 seconds or longer, and thereafter, the steel sheet may be cooled to room temperature. In the process of maintaining the isothermal temperature, partitioning of the alloying elements is performed once again, and the partitioning here is called secondary partitioning.

The average cooling rate during the cooling is preferably less than 20° C./s in order to make the shape of the sheet uniform. By the primary partitioning, although the austenite is sufficiently stabilized and slowly cooled, polygonal ferrite may not be formed at the time of cooling. However, if the cooling is too slow, productivity may be lowered, and thus, a cooling rate of 5° C./s or higher is preferable.

The cooling end temperature is preferably in the range of Ms to Bs because supersaturation is less at temperatures higher than Bs so that secondary partitioning does not occur, and diffusion is very slow at temperatures lower than Ms so that time required for the partitioning is significantly increased. In the component system satisfying the composition of the present disclosure, the partitioning time of 30 seconds or more may be sufficient in the range of Ms to Bs.

Meanwhile, the steel sheet may pass through a slow cooling section immediately after annealing in order to suppress skewing of the steel sheet during cooling after annealing. In the present disclosure, the cooling rate refers to an average temperature from the temperature at which soaking heat treatment is performed to the cooling end temperature.

In the case of manufacturing the cold-rolled steel sheet after the secondary annealing, Ni or Fe plating may be performed on the surface of the steel sheet after the secondary annealing, and a coating weight thereof may be in the range of 5 to 40 mg/m$^2$. The Ni or Fe plating layer formed in this manner improves phosphatability to improve the electrodeposition performance and welding characteristics.

Figure 4:
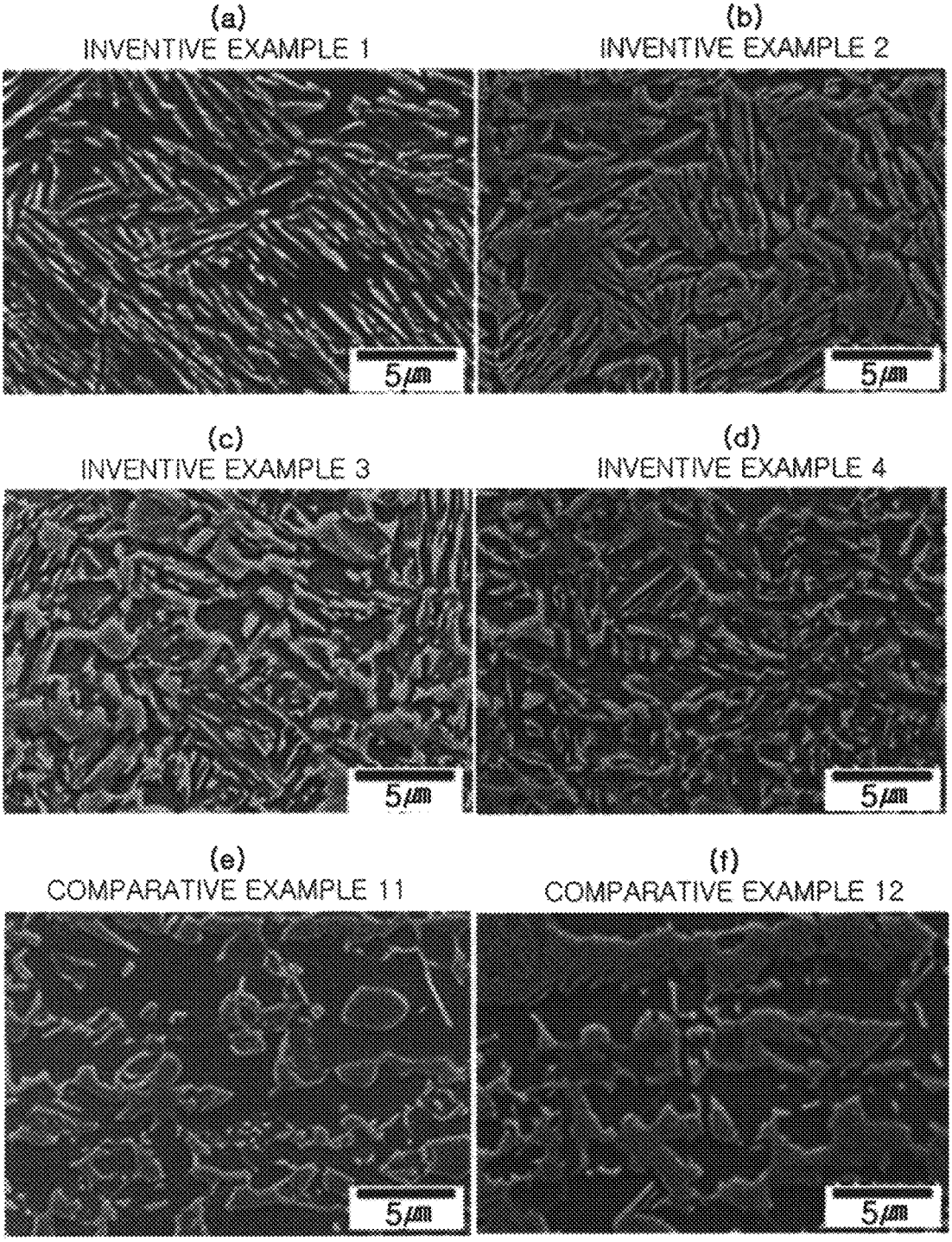
FIG. 4 is photographs of microstructures observed in order to compare differences in microstructures between inventive examples and comparative examples.

As described above, according to the present disclosure, after the primary annealing, the formed low-temperature structure is heated in the range of Ac1 to Ac3 and maintained to induce primary partitioning of alloying elements such as carbon and manganese, along with fast inverse transformation, and the structure is cooled and re-heated to induce secondary partitioning to obtain a unique lath-type microstructure illustrated in FIG. 4 and simultaneously secure excellent hole expansion ratio and elongation, compared with a structure obtained through the conventional method.

[Plating]

Plating may be performed on the primarily annealed cold-rolled steel sheet using hot-dipping or alloying hot-dipping as secondary annealing, and a plating layer formed therefrom may be a zinc-based plating layer.

In the case of using hot-dipping, the steel sheet may be immersed in a zincate plating bath so as to be manufactured as a hot-dip metal coated steel sheet, and also, in the case of an alloying hot-dipping, an alloying hot-dip metal coated steel sheet may be manufactured by performing a general alloying hot-dipping treatment. This is to prevent generation of Mn or Si oxide formed on the surface and surface concentration of Mn or Si by plating Ni or Fe on the surface of the cold-rolled steel sheet.

Figure 7:
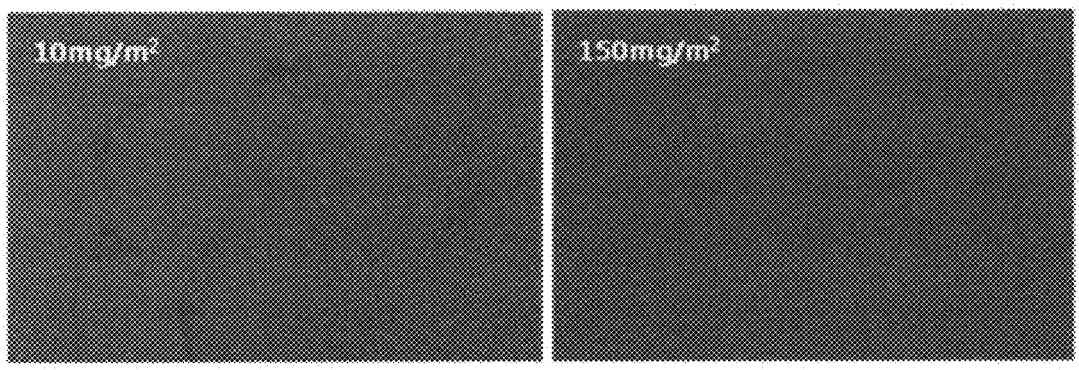
FIG. 7 is a photograph of a comparison of unplating defects of a hot-dip galvanized steel sheet according to Ni plating amount.

Meanwhile, in the present disclosure, preferably, after the primary annealing, a hot-dip galvanizing treatment may be performed after Ni or Fe plating is performed with a coating weight of 100 mg/m$^2$ or greater on the surface of the steel sheet. This is to prevent generation of Mn or Si oxides formed on the surface and surface concentration of these elements by plating Ni or Fe more strongly on the surface of the cold rolled steel sheet. As a result, a hot-dip galvanized steel sheet free of uncoated steel sheets may be manufactured by virtue of increased wettability of the base steel sheet having little surface oxidation layer and hot-dip galvanizing. If the Ni or Fe coating weight is less than 100 mg/m$^2$, unplating occurs as shown in FIG. 7 and intensive corrosion occurs on the unplated surface later. Further, welding cracks occur in a spot-welded portion to lower fatigue life.

Hereinafter, the present disclosure will be described more specifically by way of examples.

Molten metal having the composition shown in Table 1 was produced by vacuum melting as an ingot having a thickness of 90 mm and a width of 175 mm. Subsequently, the ingot was reheated at 1200° C. for 1 hour to be homogenized, and then was subjected to hot strip finishing mill at a temperature of 900° C. or higher, which is higher than Ar3, to produce a hot-rolled steel sheet. Thereafter, the hot-rolled steel sheet was cooled and then charged into a preheated furnace at 600° C., maintained for 1 hour, and then subjected to furnace cooling to thereby simulate coiling. Also, the hot-rolled sheet was cold-rolled at a cold reduction rate of 50% to 60% and annealed under the conditions of Table 2 to manufacture a final cold-rolled steel sheet.

TABLE 1

| Steel number | C | Si | Mn | P | S | Al | Cr | Ni | Mo | Ti | B | N | Classification |
|---|---|---|---|---|---|---|---|---|---|---|---|---|---|
| 1 | 0.08 | 0.7 | 1.5 | 0.008 | 0.003 | 0.02 | 0.5 | 0.02 | | | 0.002 | 0.003 | Steel of present invention |
| 2 | 0.14 | 1.5 | 2 | 0.012 | 0.005 | 0.14 | 0.02 | 0.02 | 0.05 | | | 0.004 | Steel of present invention |
| 3 | 0.22 | 1.5 | 1.8 | 0.011 | 0.006 | 0.48 | 0.01 | 0.11 | | 0.025 | 0.0017 | 0.004 | Steel of present invention |
| 4 | 0.18 | 1.8 | 2.5 | 0.008 | 0.004 | 0.03 | 0.5 | 0.02 | | 0.023 | 0.0015 | 0.006 | Steel of present invention |
| 5 | 0.07 | 0.3 | 1.4 | 0.011 | 0.006 | 0.04 | 0.02 | 0.02 | | | | 0.004 | Comparative steel |
| 6 | 0.35 | 1 | 1.2 | 0.009 | 0.006 | 0.8 | 0.01 | 0.01 | | | | 0.003 | Comparative steel |
| 7 | 0.2 | 0.8 | 3.5 | 0.008 | 0.004 | 0.02 | 0.02 | 0.02 | | | | 0.004 | Comparative steel |

In Table 1, steel Nos. 1 to 4 satisfy the steel composition range of the present disclosure, and the content of C, Si, and Mn of comparative steels 5 to 7 are not within the range of the present invention. In detail, Si and Mn of comparative steel 5 are not within a lower limit and the content of carbon of comparative steel 6 is higher than claim coverage and Al is very high. The content of Mn of comparative steel 7 is 3.5%, which is not within 3% as the claim coverage.

Subsequently, the cold-rolled steel sheet having the above composition was annealed under the heat treatment conditions as shown in Table 2 below. The Ms and Bs at this time were calculated and are shown in Table 2 below. Here, the chemical element refers to a weight percentage of the added element, Bs denotes a bainite transformation starting temperature, and Ms denotes a martensitic transformation starting temperature. Here, Ms and Bs were calculated by the following equation.

$$Ms=539-423C\ \%-30.4Mn\ \%-16.1Si\ \%-59.9P\ \%+43.6A1\%-17.1Ni\ \%-12.1Cr\ \%+7.5Mo\ \%$$

$$Bs=830-270C\ \%-90Mn\ \%-37Ni\ \%-70\ Cr\ \%-83Mo\ \%$$

annealing were measured and results thereof are also shown in Table 2 above. Here, the tensile sample of JIS No. 5 was used, and the HER was evaluated as 120×150 mm. Specifically, in Table 2, HER is a hole expansion ratio, and a hole was machined by a 10 mm punch under a condition of a clearance of 12%, then a burr generation surface was brought to the upper side and processing was performed until cracks were visible on a processed surface with a cone of 60° on a lower side, and the value was obtained by the following relational expression 3.

$$HER\ (\%)=(\text{hole diameter after machining}-\text{hole diameter before machining},10\ \text{mm})/\text{hole diameter before machining} \quad \text{[Relational expression 3]}$$

Meanwhile, regarding the sample subjected to the secondary heat treatment, ferrite, bainite, retained austenite and martensite were analyzed by analyzed by back scattering electron diffraction (EBSD), and here, for the ferrite, retained austenite, and bainite, IQ distribution of EBSD was taken as being the sum of three curves with a Gaussian

TABLE 2

| | | Annealing condition (° C.) | | | | | | | | Physical properties | | | |
|---|---|---|---|---|---|---|---|---|---|---|---|---|---|
| | | Primary | | | | Secondary | | | | | | | |
| Classification | Steel No. | Soaking | Cooling end | CR (° C./s) | F (%) | Soaking | Cooling end | Ms (° C.) | Bs (° C.) | YS (MPa) | TS (MPa) | EL (%) | HER (%) |
| Inventive example 1 | 1 | 850 | 330 | 18 | 12 | 830 | 400 | 442 | 638 | 567 | 983 | 26.5 | 37 |
| Inventive example 2 | 2 | 840 | 350 | 15 | 7 | 820 | 420 | 400 | 607 | 590 | 1003 | 24.9 | 39 |
| Inventive example 3 | 3 | 830 | 310 | 14 | 5 | 810 | 390 | 385 | 605 | 633 | 1089 | 27.8 | 31 |
| Inventive example 4 | 4 | 840 | 300 | 12 | 2 | 820 | 400 | 353 | 521 | 685 | 1214 | 20.3 | 28 |
| Comparative example 5 | 5 | 850 | 320 | 20 | 64 | 820 | 400 | 463 | 685 | 608 | 925 | 19.4 | 33 |
| Comparative example 6 | 6 | 825 | 280 | 14 | 3 | 810 | 400 | 373 | 628 | 703 | 1151 | 21.3 | 18 |
| Comparative example 7 | 7 | 830 | 300 | 5 | 0 | 800 | 390 | 336 | 461 | 722 | 1445 | 8.2 | 43 |
| Comparative example 8 | 1 | 810 | 450 | 15 | 83 | — | — | 442 | 638 | 350 | 683 | 31.7 | 56 |
| Comparative example 9 | 2 | 820 | 420 | 16 | 74 | — | — | 400 | 607 | 422 | 760 | 25.2 | 24 |
| Comparative example 10 | 2 | 840 | 350 | 5 | 42 | 820 | 420 | 400 | 607 | 453 | 840 | 26.1 | 22 |
| Comparative example 11 | 3 | 830 | 440 | 18 | 67 | — | — | 385 | 605 | 521 | 923 | 24.6 | 6 |
| Comparative example 12 | 3 | 830 | 310 | 5 | 31 | 810 | 390 | 385 | 605 | 580 | 1054 | 26.5 | 13 |
| Comparative example 13 | 4 | 810 | 400 | 17 | 66 | — | — | 353 | 521 | 511 | 962 | 20.8 | 8 |
| Comparative example 14 | 4 | 840 | 300 | 5 | 28 | 820 | 400 | 353 | 521 | 536 | 997 | 21.9 | 16 |

*In Table 2, CR represents a cooling rate, and F represents a ferrite area fraction in the structure after primary annealing.

In the secondary annealing, a cooling rate was 12° C./s and a maintaining time at the cooling end temperature was 120 seconds except for Comparative Example 7. In Comparative Example 7, since the Mn content was high, isothermal temperature was maintained for 300 seconds in order to sufficiently induce bainite transformation. The yield strength, tensile strength, elongation and hole expansion ratio (HER) of the cold-rolled steel sheet after the secondary distribution and the mean kernel misorientation was taken at a point of inflection to perform phase separation. Also, a grain size of the ferrite was evaluated by an image analyzer with an installed analysis program (crystal grain measurement method of ASTM E112) which assumes that several hexagons are connected. The differences in structural analysis between the inventive and comparative examples are shown in Table 3 below.

TABLE 3

| Classification | F | | | | | | |
|---|---|---|---|---|---|---|---|
| | GS (μm) | Area fraction (%) | Fa5 (%) | Fn2 (%) | Area fraction (%) | Area fraction (%) | Area fraction (%) |
| Inventive example 1 | 1.3 | 52.1 | 68.4 | 91.5 | 28.1 | 8.7 | 11.1 |
| Inventive example 2 | 1 | 36.7 | 22.4 | 91 | 43.8 | 8.6 | 10.9 |
| Inventive example 3 | 1.2 | 48.1 | 65.9 | 93.8 | 30.6 | 9.5 | 11.8 |
| Inventive example 4 | 1.2 | 46/1 | 51.7 | 92.9 | 32.2 | 11.3 | 10.4 |
| Comparative example 5 | 1.4 | 20 | 52.1 | 81.7 | 54.3 | 20.3 | 5.4 |
| Comparative example 6 | 1.3 | 10.6 | 38.7 | 79.7 | 62.9 | 18.6 | 7.9 |
| Comparative example 7 | 1.2 | 26.5 | 71.3 | 72.8 | 55.7 | 14.7 | 3.1 |
| Comparative example 8 | 4.2 | 73.1 | 94.6 | 45.2 | 14.2 | 2.1 | 10.6 |
| Comparative example 9 | 3.3 | 68.9 | 87.5 | 58.1 | 19.5 | 5.3 | 6.3 |
| Comparative example 10 | 2.7 | 62.2 | 83.8 | 77.1 | 24.4 | 3.8 | 9.6 |
| Comparative example 11 | 2.2 | 64.6 | 83.4 | 62.3 | 17.3 | 9.9 | 8.2 |
| Comparative example 12 | 1.9 | 57.3 | 80.1 | 84.9 | 23.2 | 8.3 | 11.2 |
| Comparative example 13 | 2.3 | 61.8 | 82.2 | 66.7 | 20.1 | 10.1 | 8. |
| Comparative example 14 | 1.8 | 55.3 | 79.9 | 85.8 | 26.5 | 8.7 | 9.5 |

*In Table 3, F denotes ferrite, B denotes bainite, M denotes martensite, and G denotes retained austenite. GS denotes an average crystal grain size of ferrite, Fn2 denotes the above-mentioned relational expression 1, and Fa5 denotes the relational expression 2.

As shown in Table 2 and Table 3, it can be seen that, in the case of Comparative Examples 5 to 7 which did not satisfy the composition range suggested in the present disclosure, the tensile strength, elongation, or HER was low although inverse transformation heat treatment was performed. In Comparative Example 5 in which Si or Mn is low, both the tensile strength and the HER are low. In Comparative Examples 6 and 7 in which C, Al and Mn were very high, only the strength was obtained very high and the HER or elongation appeared low.

Meanwhile, all of Comparative Examples 8, 9, 11, and 13 which satisfy the components proposed in the present disclosure but employed the general annealing method did not have high strength. That is, Comparative Examples 8 and 9 in which carbon, Si and Mn were low exhibited excellent elongation and HER but could not obtain 980 MPa or more as intended tensile strength. In Comparative Examples 11 and 13 in which alloying elements were added in a large amount, tensile strength was slightly low but the HER was significantly lowered. As shown in Tables 3 and 2, in Comparative Examples 11 and 13, when the strength was high as the area fraction of the ferrite grains having a size of 5 μm or greater accounts for 80% to 95% of the entire ferrite, it means that strength of the second phase was very high, and thus, the HER decreased rapidly. This is because the conventional heat treatment method in which heat treatment is performed once is the same as the secondary annealing conditions of the present disclosure, in that primary partitioning in the temperature range of the coexistence of ferrite and austenite during soaking and then secondary partitioning is performed by performing an isothermal heat treatment in a bainite transformation temperature range, but coarse polygonal ferrite and austenite are formed during soaking.

In Table 2, in Comparative Examples 10, 12 and 14, both the primary and secondary annealing conditions are satisfied, but since the cooling rate after the soaking in the primary annealing is as low as 5° C./s, coarse ferrite is formed in the cooling process, and thus, as shown in Table 3, the area of the ferrite exceeded 60% or the area fraction of the ferrite grains having a size of 5 μm or greater was about 80% or greater, so that the tensile strength and HER were not high.

Meanwhile, important factors discovered by the inventors of the present application were that when ferrite grains are fine, and particularly, have a lath-type structure, they may have high mechanical properties of hole expansion ratio and elongation which cannot be compatible, while having high strength.

FIG. 1 is photographs of a composition of steel microstructures affecting hole expansion ratio and elongation and effects of geometrical structure. FIG. 1 (*a*) corresponds to Comparative Example 11 which was annealed by the conventional heat treatment method. After two phase annealing, it was cooled and isothermally maintained at 440° C. at which bainite transformation took place. This is because coarse ferrite is formed with polygonal ferrite and austenite in the case of two phase annealing. After cooling, as bainite transformation is performed in the austenite, the retained austenite is stabilized at the same time, obtaining the structure shown in FIG. 1(*a*). In inventive example 1 of FIG. 1(*b*), carbon, Mn, and Si were not high but a sufficient amount of low-temperature transformed structure was formed in the primary annealing, and the austenite appears between martensite or bainite lath due to inverse transformation of these transformed structures during the secondary annealing, primary partitioning occurs at the interface to obtain the lath-type austenite and ferrite structure. When the structure is cooled again and then subjected to an isothermal heat treatment in the bainite region, the bainite appears from the lath-type austenite to perform secondary partitioning, and thus, the austenite becomes more stable phase and remains even at room temperature.

Comparative Example 7 of FIG. 1(*c*) is steel having a very high Mn content, in which a large amount of ferrite was not formed much at a low cooling rate of the primary annealing and most austenite was transformed into bainite when the temperature was isothermally maintained at low temperatures for 300 seconds during secondary annealing.

This structural difference affects strength, HER and elongation. As shown in FIG. 2, in the coarse polygonal ferrite and the second phase structure (a: Comparative Example 11), cracking propagates along the boundary between the ferrite and the second phase, so that the HER is extremely low. In contrast, in (b) (Inventive Example 1) and (c) (Comparative Example 7) in which ferrite is isolated, since cracking propagates while breaking the hard second phase, crack growth is resisted to result in a high HER. On the other hand, elongation is greatly affected by a fraction of retained austenite. As can be seen from the EBSD results shown in FIG. 1, (a) and (b) contain 8% and 11% of retained austenite, respectively, and accordingly, elongations amounts to 24.6% and 26.5%, respectively. Particularly, Inventive Example 1 (b) in which the structure was fine has a high strength and excellent elongation. It can be seen from the photograph of FIG. 4 observed by a secondary electron microscope that the lath-type ferrite and the polygonal ferrite in which a length ratio of the longer side to the shorter side is 4 or greater are remarkably developed compared with the conventional manufacturing method.

Particularly, in order to quantify the structural characteristics of ferrite, evaluation was made with an image analyzer having an analysis program in which the size of crystal grains was taken as being connected as several hexagons (crystal grain measuring method of ASTM E112). The number distribution of crystal grains is very different as shown in FIG. 5. In Inventive Example 2, fine lath-type ferrite having a particle size of about 1 μm is distributed at a very high density, whereas in Comparative Example 12, polygonal ferrite grains having a size of 1 to 3 μm are large and grains having a size of 3 to 5 μm are relatively high in frequency.

Table 3 shows the structural characteristics of each of the samples subjected to the steel composition components in Table 1 and the heat treatment conditions in Table 2. As shown in Table 3 and Table 2, the ferrite has an average grain diameter of 2 μm or less, and it was discovered that, when very fine lath-type ferrite in which Fn2 defined by relational expression 1 is 89% or greater and Fa5, defined by relational expression 2, satisfies 70% or less is developed in ferrite, all of HER, ductility, and strength were excellent.

Figure 6:
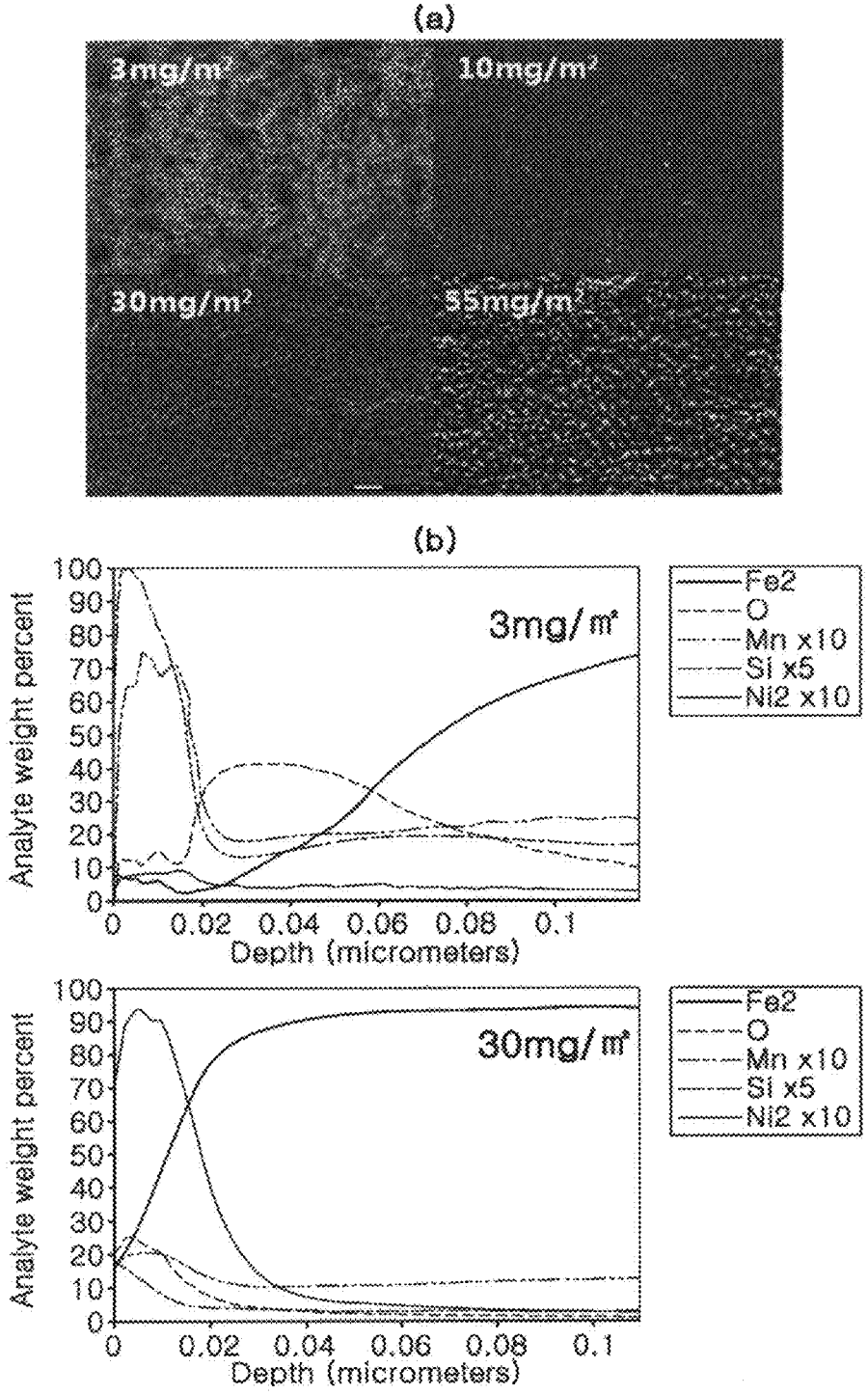
FIG. 6 shows influence of Ni plating amount on phosphatability.

FIG. 6 shows the influence of the Ni plating amount on phosphatability. Regarding Inventive Example 4, after primary and secondary annealing, a Ni plating amount was changed up to 50 mg/m$^2$. A nickel sulfate was used as a Ni plating solution, and the plating amount was changed by adjusting a current at a predetermined PH condition. Thereafter, a coating was formed in a 45° C. phosphate solution for 150 seconds, washed and dried, and a coating crystal was observed with a secondary electron microscope and surface components of samples of 3 mg/m$^2$ and 30 mg/m$^2$ were analyzed by GDS analysis.

As shown in FIG. 6(*a*), as the amount of Ni plating increases, crystals of phosphate become coarse. This is because a rate of growth is faster than a rate of nucleation. On the other hand, it can be seen that, in the sample with the Ni plating amount of 3 mg/m$^2$, phosphate nucleation is difficult due to the influence of surface oxide, rarely forming a coating.

FIG. 6(*b*) shows the results of GDS analysis for samples of Ni plating amounts of 3 mg/m$^2$ and 30 mg/m$^2$. As described above, in the sample having a small amount of Ni plating, large amounts of surface oxides and internal oxides were present on the surface of the base steel sheet and the concentrations of Si and Mn were large and the oxygen concentration on the surface was high. On the other hand, the sample of Ni plating amount of 30 mg/m$^2$ had low concentration of oxygen due to oxygen blocking action of surface Ni, and as a result, the amount of surface concentrated Si and Mn was not high.

FIG. 7 shows the results obtained by performing hot-dip galvanizing after Ni plating of 10 mg/m$^2$ and 150 mg/m$^2$ before the secondary hot-dip galvanizing annealing after primary annealing. In the sample of 10 mg/m$^2$, some oxides were present on the surface during the secondary annealing and an unplated layer was observed, but, in the sample of 150 mg/m$^2$, the plating surface was fine and unplating defect was not observed. This is because, since stronger Ni was plated, the generation of Mn or Si oxides on the surface and surface concentrations of these elements were prevented.

Figure 8:
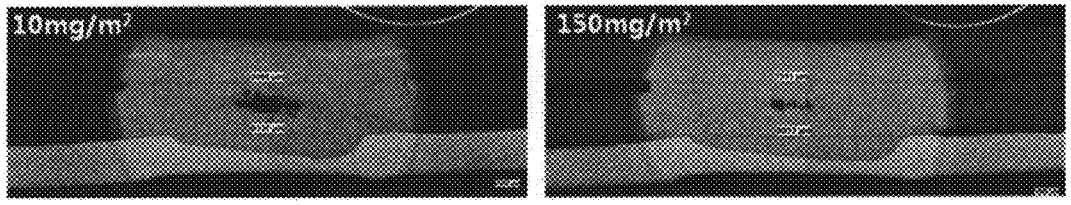
FIG. 8 is a graph showing a degree of cracks of spot welded portions according to a Ni plating amount.
Figure 8:
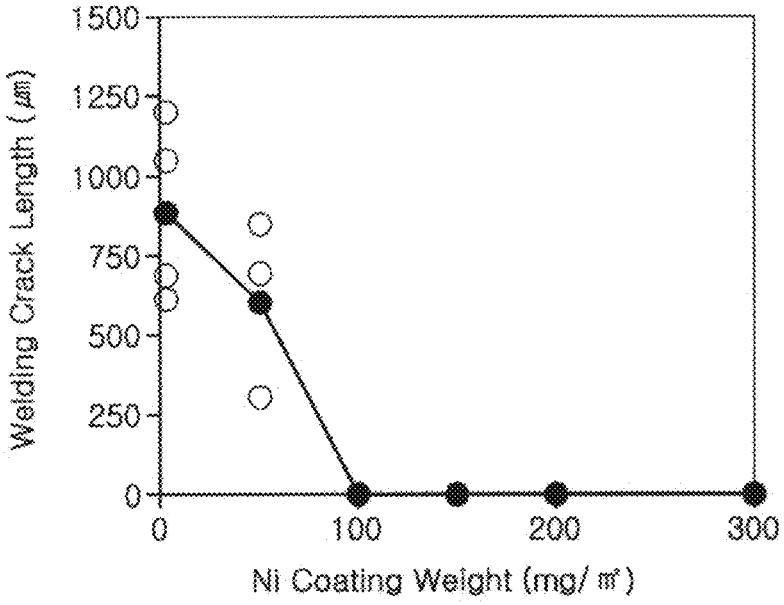

FIG. 8 shows observation of cracks of a welded cross-section after performing spot welding after Ni plating of 10 to 300 mg/m$^2$ before secondary hot-dip galvanizing annealing after primary annealing. For spot welding, pressing force was 4 kN and a welding current was 7 kN. As a result, welding cracks did not occur in the Ni plated sample of 100 mg/m$^2$. This is because, as Ni is diffused into the surface and plating layer of the steel and melts to increase a melting temperature of the plating layer. Welding cracking is a phenomenon that occurs as molten zinc penetrates into a grain boundary of the base steel sheet in a state in which stress is applied, in which Ni increases a melting point of the molten zinc to increase a penetration temperature of liquid zinc.

Based on the results, the cold-rolled steel sheet manufactured according to the present disclosure has a tensile strength of 980 MPa or greater and excellent elongation, as well as excellent phosphatability and plating adhesion. Accordingly, corrosion resistance of the parts may be improved, weld cracks are not generated, fatigue life of assembled parts is extremely excellent, so that the cold forming for application to a structural member is facilitated to significantly improve durability of parts, compared with steel produced through the conventional Q & P heat treatment process.

While exemplary embodiments have been shown and described above, it will be apparent to those skilled in the art that modifications and variations could be made without departing from the scope of the present disclosure as defined by the appended claims.

The invention claimed is:

1. A cold-rolled steel sheet comprising:

in % by weight, 0.05 to 0.3% of carbon (C), 0.6 to 2.5% of silicon (Si), 0.01 to 0.5% of aluminum (Al), 1.5 to 3.0% of manganese (Mn), and the remainder being Fe, and unavoidable impurities; and a microstructure comprising, in an area fraction, ferrite in an amount of 60% or less, lath bainite of 25% or more, martensite of 5% or more, and lath retained austenite in an amount of 5% or more, wherein the ferrite has an average grain diameter of 2 μm or less, and wherein the ferrite satisfies Fn2, defined by relational expression 1, being 89% or more and Fa5, defined by relational expression 2, being 70% or less:

$$Fn2=[\text{Number of ferrite grains of 2 μm or less/number of total ferrite grains}]\times 100 \quad \text{[Relational expression 1]}$$

$$Fa5=[\text{area of ferrite grains of 5 μm or greater/area of total ferrite grains}]\times 100. \quad \text{[Relational expression 2]}$$

2. The cold-rolled steel sheet of claim 1, wherein 2% by weight or less, excluding 0% by weight, of at least one of Cr, Ni, and Mo is additionally included.

3. The cold-rolled steel sheet of claim 1, wherein 0.05% by weight or less, excluding 0% by weight, of Ti and 0.003% by weight or less, excluding 0% by weight, of B are additionally included.

4. The cold-rolled steel sheet of claim 1, wherein a Ni or Fe plating layer is formed at a coating weight of 5 to 40 mg/m$^2$ on a surface of the cold-rolled steel sheet.

5. The cold-rolled steel sheet of claim 1, further comprising: a hot-dip galvanized plating layer formed on a surface of the cold-rolled steel sheet, and a Ni or Fe plating layer formed at a coating weight of 100 mg/m$^2$ or greater between the cold-rolled steel sheet and the hot-dip galvanized plating layer.

6. The cold-rolled steel sheet of claim 5, wherein the hot-dip galvanized plating layer includes an alloying hot-dip galvanized plating layer formed on a surface of the hot-dip galvanized plating layer.

7. The cold-rolled steel sheet of claim 1, wherein the ferrite includes lath ferrite ferrite.

* * * * *